United States Patent [19]

Williams

[11] 4,014,123

[45] Mar. 29, 1977

[54] FIREARM SAFETY DEVICE

[76] Inventor: Coral C. Williams, 714 W. Lowden St., Fort Worth, Tex. 76110

[22] Filed: Sept. 17, 1975

[21] Appl. No.: 614,348

[52] U.S. Cl. ..... 42/1 LP

[51] Int. Cl.[2] ..... F41C 17/08; F41C 27/00

[58] Field of Search ..... 42/1 LP, 70 R, 70 C, 42/70 D, 70 E, 70 F

[56] References Cited

UNITED STATES PATENTS

| | | | |
|---|---|---|---|
| 716,946 | 12/1902 | Seoane | 42/1 LP |
| 3,462,869 | 8/1969 | Wallace | 42/70 F |
| 3,553,877 | 1/1971 | Welch et al. | 42/1 LP |
| 3,735,519 | 5/1973 | Fox | 42/1 LP |

*Primary Examiner*—Charles T. Jordan
*Attorney, Agent, or Firm*—James C. Fails

[57] ABSTRACT

A firearm safety device comprising a pair of combination lock type dials mounted concentrically and rotatably on the gun casing. The dial in contact with the casing has an aperture spaced a selected radial distance from the center. The other dial has a pocket spaced the same distance so that they may be aligned together. A plunger is mounted in the casing at the same distance and is spring biased outwardly and axially movable. The inner end of the plunger is extensible into a moving part of the firing mechanism. Aligning the pocket and aperture with the plunger allows it to spring out of engagement with the moving part, therefore releasing the safety, or unlocking the firearm. Sloping grooves adjacent the pocket and aperture depress the plunger when the dials are rotated.

9 Claims, 7 Drawing Figures

FIREARM SAFETY DEVICE

BACKGROUND OF THE INVENTION

1. Field of the Invention

This invention relates in general to locking devices and in particular to a firearm safety device.

2. Description of the Prior Art

There are many varieties of safety lock devices for firearms in the patented art. Some of them are external, thus must be detached to be unlocked. Others are internal, both key type as in U.S. Pat. No. 3,462,869, and combination type as in U.S. Pat. No. 3,735,519.

Many of the prior art safety devices, or locks, are not suitable for police usage. A safety lock is desirable to prevent unauthorized use if an officer's revolver is grabbed in a crowd or by one whom he is trying to apprehend. Officers on many occasions have been shot by their own revolvers. However, external locks are unsatisfactory since they must be detached and are cumbersome. The disadvantage of a key operated lock is that an unauthorized user might take the key. Also, unlocking by key may be too slow during emergencies. Actuation of code combination locks may be too slow during emergencies. Moreover many are complex and must be installed at the manufacturing level, or are difficult to install on existing revolvers. In addition, certain of the prior art locks, or safeties, prevent a revolver from being carried in a holster without modification.

SUMMARY OF THE INVENTION

It is accordingly a general object of this invention to provide an improved safety device for a firearm.

It is another object of this invention to provide an improved code combination safety locking device for a firearm that is easily installed on existing firearms.

It is another object of this invention to provide a safety locking device particularly suitable for police revolvers in that it is fast to actuate, and does not interfere with a holster.

In accordance with these objects a safety device for a firearm is provided that has a code combination type lock. Two concentric dials are rotatably attached to the gun casing adjacent a moving part of the firing mechanism. A plunger is mounted axially movable laterally in the casing, behind the dials and eccentric to their centers. An aperture and a pocket or recess allows the plunger to spring out of engagement with the moving part when the dials are properly aligned; consequently, freeing the firing mechanism and allowing the gun to be fired.

DESCRIPTION OF THE PREFERRED EMBODIMENT

Figure 1:
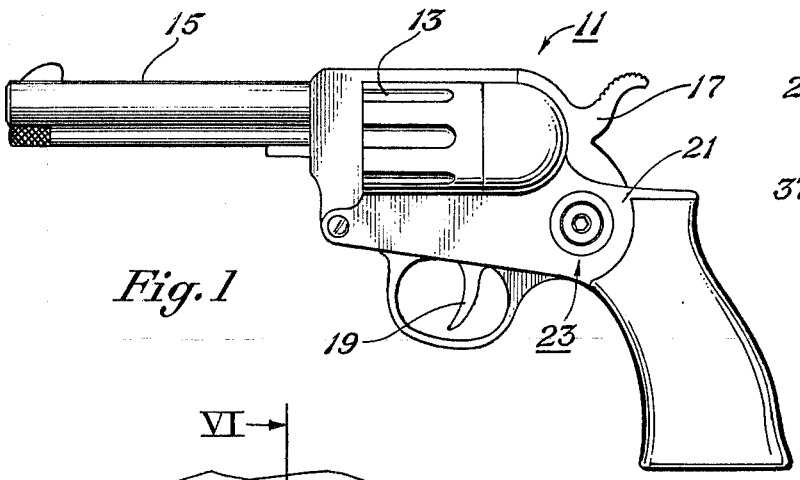
FIG. 1 is an elevational view of a revolver having installed the safety, or locking, device according to this invention.
Figure 5:
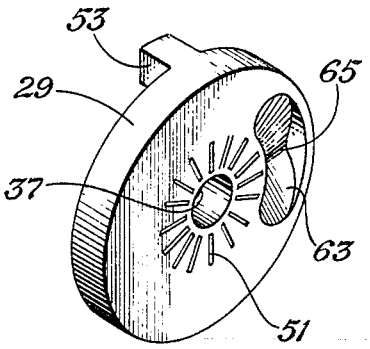
FIG. 5 is an isometric view of the rear of the smaller dial of FIG. 3.
Figure 2:
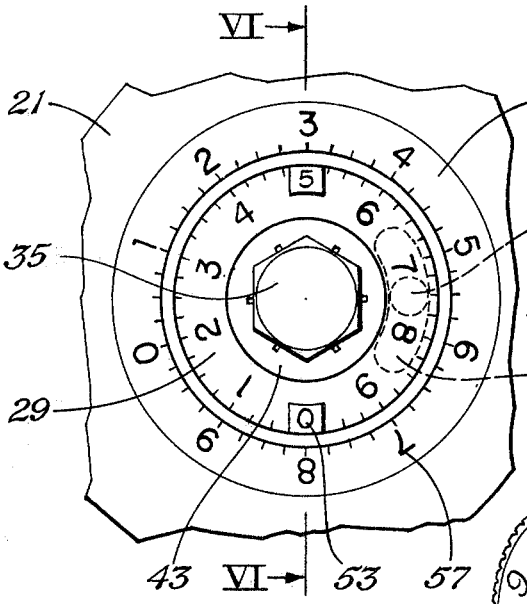
FIG. 2 is an enlarged elevational view of the locking device of FIG. 1.
Figure 3:
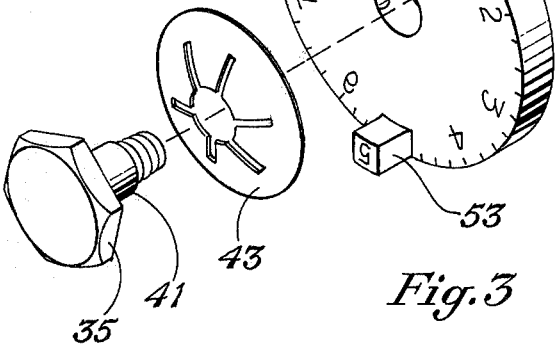
FIG. 3 is an exploded and enlarged isometric view of the safety device of FIG. 1.
Figure 4:
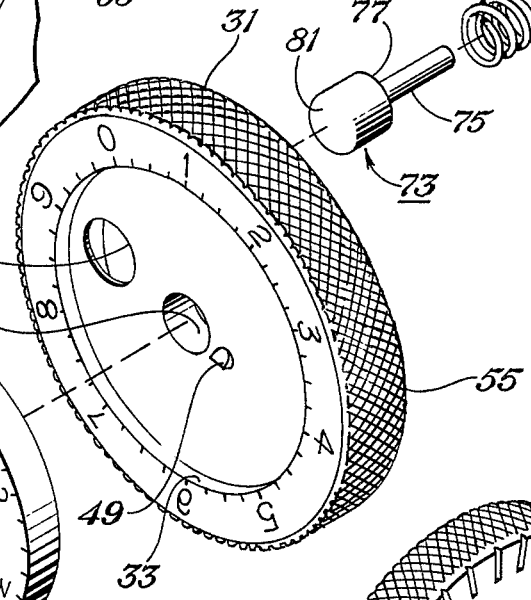
FIG. 4 is an isometric view of the rear of the larger dial of FIG. 3.
Figure 4:
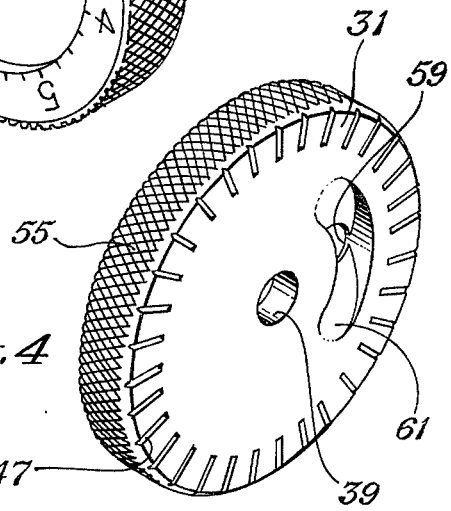

A typical revolver 11 is shown in FIG. 1, having a cylinder 13, barrel 15, hammer 17, and trigger 19. Hammer 17 and trigger 19 are two of the moving parts of the firing mechanism, and are partially enclosed by the revolver casing 21.

Figure 6:
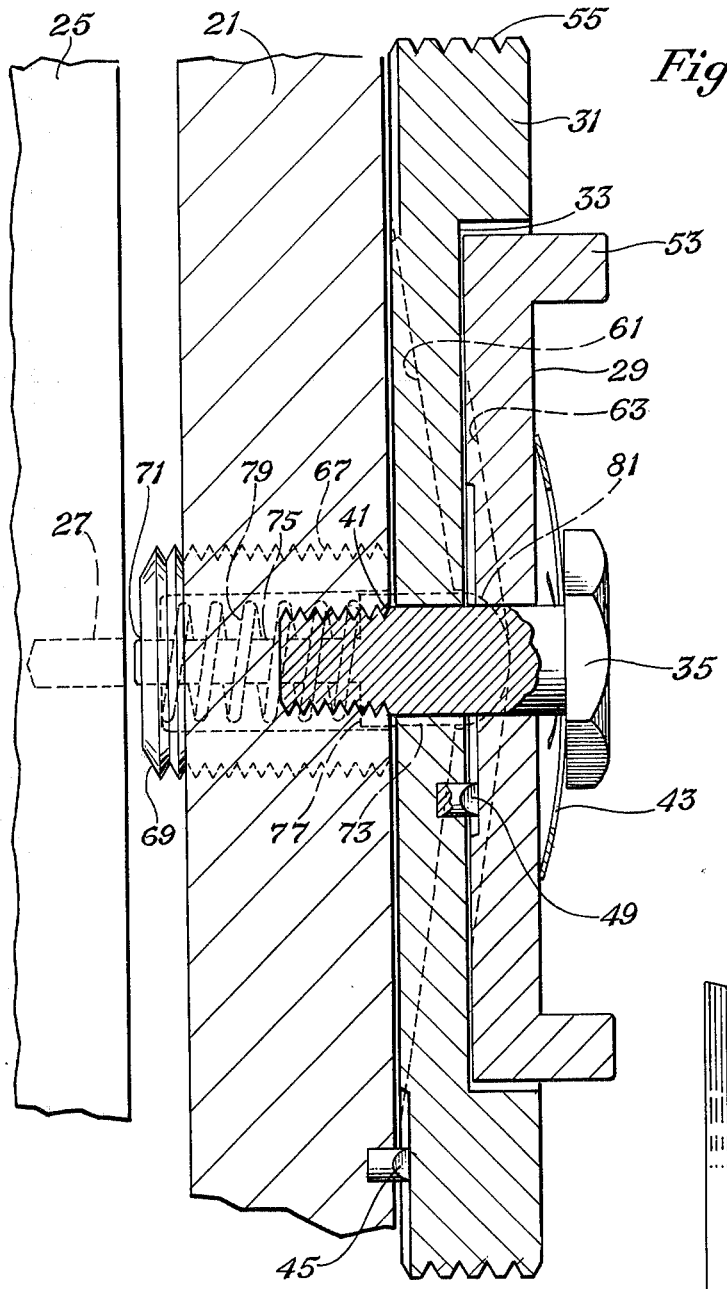
FIG. 6 is an enlarged partial cross-sectional view of FIG. 2 taken along the lines VI—VI, shown in an unlocked position.
Figure 7:
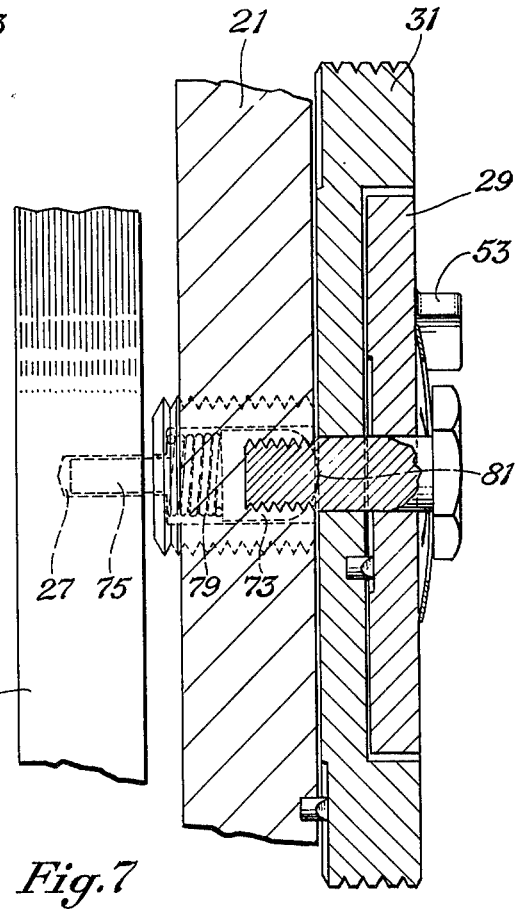
FIG. 7 is a view of FIG. 6 shown in a locked position.

A safety, or locking, device 23 is mounted on the casing 21 adjacent a moving part 25, FIGS. 6, 7, of the firing mechanism. Moving part 25 may be a portion of the trigger 19, hammer 17, or other elements. Preferably it is flat and should be large enough for a 1/16 inch to ⅛ inch diameter aperture, indicated as numeral 27, FIGS. 6, 7, to be drilled in it. The moving part should be vital to the firing mechanism so that preventing it from moving will prevent the firearm from firing.

Referring to FIGS. 2-7, locking device 23 has a second dial 29 mounted over and concentrically with a first dial 31. Dial 29 is smaller than dial 31 and fits within a recessed portion 33. A bolt 35 with a wide head rotatably attaches the dials to casing 21 through center apertures 37, 39. Bolt 35 has a shoulder 41 that prevents the bolt from compressing the dials 29, 31 too tightly and consequently preventing rotation.

A curved circular spring 43 is inserted between the head of bolt 35 and second dial 29, to provide a measure of friction against rotation. A small point or wedge 45, FIGS. 6, 7, inserted into the casing 23 engages serrations 47, FIG. 4, on the back side of the first dial 31, to cooperate with spring 43 in providing rotational friction. Similarly a wedge 49 is inserted in recessed portion 33 of dial 31 and engages serrations 51 on the back of second dial 29. Tabs 53 on the face of dial 29 and knurled edges 55 on dial 31 provide gripping surfaces.

Both dials are disc-shaped and have indicia 57 on their faces, serving as code indicators. First dial 31 has an aperture 59 on its back or inner side at a selected radial distance from center aperture 39. A groove 61 extends in an annular arc for a selected distance on both sides of aperture 59. Groove 61 slopes generally deeper from its ends toward aperture 59, with groove 61 intersecting the face of dial 31 at aperture 59.

Dial 29 has a similar sloping groove 63 on its back or inner side at the same distance from center aperture 37. Groove 63, however, does not intersect the face of dial 29. The deepest portion is designated as pocket 65 and is alignable with aperture 59.

A cylinder 67 having external threads and a hollow smooth interior is screwed into the revolver casing 21 at the same selected distance from center apertures 37, 39 as aperture 59 and pocket 65. The selected distance depends primarily on the size of the dials 29, 31. Cylinder 67 should be placed adjacent a suitable moving part 25 of the firing mechanism. Cylinder 67 has a bottom 69 with an aperture 71, FIGS. 6, 7, and an open top which is mounted flush with the exterior side of casing 21. Normally cylinder 67 is thicker than casing 21, thus the bottom 69 will extend into the interior of the revolver. Bottom 69 should be close to moving part 25.

A plunger 73 fits closely within the interior of cylinder 67 and is movable along its longitudinal axis. Plunger 73 has a reduced portion, or finger, 75, that is extensible through cylinder aperture 71 into moving part aperture 27. At the base of finger 75, plunger 73 enlarges to cylinder 67 width, thereby forming a shoulder 77. A coil compression spring 79 encircles finger 75 between cylinder bottom 69 and shoulder 77. Coil spring 79 serves as means for urging the plunger toward the dials 29, 31 and exterior of casing 21. The end of plunger 73 opposite finger 75, designated exterior end 81, is rounded so that it will smoothly engage the dials 29, 31. The diameter of plunger 73 is of a size that allows its rounded end to be closely received in grooves 61, 63 and aperture 59. The length of plunger 73 is such that while received in pocket 65, finger 75 will be completely withdrawn from moving part aperture 27, as shown in FIG. 6. However, finger 75 will still engage moving part 25 if plunger 73 is extended only as far as first dial aperture 59. If neither aperture 59 nor pocket 65 are aligned with plunger 73, its rounded end 81 will be in contact with the back side of first dial 31 and aligned with the exterior side of casing 21, as shown in FIG. 7.

The safety device 23 is installed by removing casing 21 and drilling aperture 27 in moving part 25, which is normally the hammer or trigger. A larger hole is drilled and tapped, or threaded, in casing 21 in alignment with aperture 27 for the insertion of cylinder 67. A center hole is then drilled and threaded in casing 21 for bolt 35 at a distance away from aperture 27 equal to the distance between center apertures 37, 39 and the center of grooves 61, 63. A hole for serration wedges 45 and 49 are drilled, then the component parts are assembled. The device should be manufactured from hard metal, such as steel or steel alloy.

In operation, locking device 23 will normally be locked as shown in FIG. 7. In this position, finger 75 is extended into moving part aperture 27, thus preventing the revolver from firing. To unlock the device, dials 29, 31 are rotated so that aperture 59 and pocket 65 are aligned with plunger 73, as shown in FIG. 6. Spring 79 will move plunger 73 axially into reception with aperture 59 and pocket 65. Finger 75 will be withdrawn, allowing the moving part 25 to move and the firearm to fire. Two simple short rotations thus unlocks the revolver. One with knowledge of the code will be guided by the indicia 57 to find this position. If it is necessary to be able to actuate the device in darkness, personalized notches or indicators may be placed on the casing 21.

If aperture 59 and pocket 65 are not aligned together, aperture 59 may be rotated passed plunger 73 without effect. The rounded end 81 of plunger 73 and sloping groove 61 allows the plunger to follow the gradual curve passed aperture 59 without detection. Consequently it would be difficult for an unauthorized user to ascertain the code by experimental rotation.

To lock the revolver, second dial 29 is initially rotated until groove 63 is no longer in contact with plunger 73. Plunger 73 is depressed by the rotation into alignment with the face of first dial 31; its finger 75 may then be in slight engagement with moving part aperture 27. First dial 31 is then rotated, further depressing plunger 73 into full engagement with moving part aperture 27. Consequently grooves 61, 63 serve as means for depressing the plunger axially within the casing into the moving part.

A cylindrical shaped plunger 73 and cylinder 67 have been described since that shape lends itself to easy construction and installation. Other shapes, such as rectangular, or with a roller end rather than rounded, may be employed, however. Grooves 61, 63, to depress plunger 73, have been described, however other devices also may be employed. For example, a hole might be provided in pocket 65, and an actuating member installed over it which would depress plunger 73 by axially depressing the actuating member.

Moreover, more than two dials may be employed if desired for greater safety.

It may readily be seen that this invention has significant advantages and achieves the objects delineated hereinbefore. The locking device is easily installable on a large variety of revolvers and other firearms, such as rifles, as well. The device is well suited for police usage in that it is quick operating, requires no separate key, or detachable objects. The device has a low profile thus does not interfere with a holster.

Although this invention has been described with a certain degree of particularity, it is understood that the present disclosure has been made only by way of example and that numerous changes in the details of construction may be resorted to without departing from the spirit or the scope of this invention.

I claim:

1. A safety device for a firearm having a firing mechanism incorporating a moving part enclosed by a casing, comprising:

a first dial, rotatably attached to the casing, having an aperture located a selected radial distance from the center;

a second dial, rotatably attached to the casing, concentric with and over the first dial, having a pocket at its inner side located at the same radial distance from the center as the aperture in the first dial;

a plunger mounted within the casing at the same radial distance from the center as the aperture in the first dial and adjacent the moving part of the firing mechanism; the plunger being axially movable and spring biased in a direction toward the dials; the plunger having a portion engageable with the moving part to prevent its movement; the plunger being of a configuration to be closely received in the aperture and pocket; and means for depressing the plunger axially within the casing into engagement with the moving part;

whereby the firearm is fireable only when the first and second dials are rotated such that the aperture and pocket are in alignment with the plunger, allowing it to spring axially away from the moving part.

2. The safety device according to claim 1 wherein the means for depressing the plunger comprises:

a first groove and a second groove, each extending in an arc for a selected annular distance around the aperture and the pocket on the sides of the first and second dials respectively; each of said grooves being of sufficient size to receive the plunger and gradually sloping toward its ends;

whereby the plunger may be depressed by initially rotating the second dial until the second groove is no longer in contact with the plunger, then rotating the first dial until the first groove is no longer in contact with the plunger.

3. The safety device according to claim 1 wherein the first and second dials are spring-biased toward the casing in order to create a desired resistance against rotation.

4. The safety device according to claim 1 wherein the moving part of the firing mechanism has an aperture for the reception of a portion of the plunger.

5. A locking device for a firearm having a firing mechanism incorporating a moving part enclosed by a casing comprising:

a first dial, rotatably attached to the casing, having an aperture located a selected radial distance from the center and a first groove extending in an arc a selected distance around the aperture; the groove gradually deepening toward the aperture;

a second dial, rotatably attached to the casing concentric with and over the first dial, having a pocket located on the inner side at the same radial distance from the center as the first dial, and a second groove extending in an arc a selected distance around the pocket; said groove gradually deepening toward the pocket;

a cylinder, mounted fixedly within the casing at the same radial distance from the center of the first dial and adjacent the moving part of the firing mechanism; the cylinder having a hollow interior and an aperture on its bottom;

an aperture in the moving part;

a plunger, closely received and axially movable within the cylinder, having a finger extending through the cylinder aperture and extensible into the aperture provided within the moving part; the end opposite the finger of the plunger being of a size to be closely received by the dial aperture, pocket, and first and second grooves; and biasing means for urging the plunger toward the dials.

6. The locking device according to claim 5 wherein the first and second dials are attached by a bolt inserted through apertures in their respective centers; and a spring is carried by the bolt for urging the dials toward the casing to increase rotation resistance.

7. The locking device according to claim 5 wherein the end opposite the finger of the plunger is rounded to reduce resistance while being depressed by the first and second grooves.

8. The locking device according to claim 5 wherein the biasing means comprises a coil spring encircling the finger and bearing against a shoulder of the plunger adjacent the finger.

9. The locking device according to claim 5 wherein the first and second dials have indicia on the outer sides.

* * * * *